US012630780B2

(12) United States Patent
Pallister et al.

(10) Patent No.: US 12,630,780 B2
(45) Date of Patent: May 19, 2026

(54) LUBRICANTS FOR USE IN VAPOR-COMPRESSION SYSTEMS

(71) Applicant: The Lubrizol Corporation, Wickliffe, OH (US)

(72) Inventors: David M. Pallister, Highland, MI (US); Eric Schweim, Rochester Hills, MI (US); Scott Miller, Midland, MI (US); Kyle Stevens, Midland, MI (US); Arthur L. Backman, Broadview Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 18/285,054

(22) PCT Filed: Mar. 30, 2022

(86) PCT No.: PCT/US2022/022429

§ 371 (c)(1),
(2) Date: Sep. 29, 2023

(87) PCT Pub. No.: WO2022/212431

PCT Pub. Date: Oct. 6, 2022

(65) Prior Publication Data

US 2024/0182809 A1 Jun. 6, 2024

Related U.S. Application Data

(60) Provisional application No. 63/169,488, filed on Apr. 1, 2021.

(51) Int. Cl.
*C10M 171/00* (2006.01)
*C10M 169/04* (2006.01)
(Continued)

(52) U.S. Cl.
CPC .... *C10M 171/008* (2013.01); *C10M 169/041* (2013.01); *C10M 2203/1006* (2013.01);
(Continued)

(58) Field of Classification Search
CPC ..... C10M 169/041; C10M 171/008; C10M 2203/1006; C10M 2203/1025;
(Continued)

(56) References Cited

U.S. PATENT DOCUMENTS 6,082,982 A * 7/2000 Rosser, Jr. ..... F04C 29/026 184/6.16
8,569,216 B2 * 10/2013 Blain ..... C10M 169/04 508/429

(Continued)

FOREIGN PATENT DOCUMENTS

CN 110951523 A * 4/2020
WO 2003/076555 9/2003
WO 2013/093080 6/2013

OTHER PUBLICATIONS

English-language machine translation of CN 110951523A (Year: 2020).*

*Primary Examiner* — James C Goloboy
(74) *Attorney, Agent, or Firm* — Christopher P. Demas; Iken S. Sans; Michael A. Miller

(57) ABSTRACT

Lubricant compositions comprising an oil of lubricating viscosity and a viscosity modifier that is a hydrocarbon polymer having a number average molecular weight ($M_n$) of less than 10,000 Daltons (Da). The viscosity modifier is present at greater than 2 wt %, based on a total weight of the lubricant composition. Exemplary hydrocarbon polymers include, but are not limited to, olefin polymers, such as polyisobutylene polybutene, ethylene α-olefin copolymers, or combinations thereof.

17 Claims, 2 Drawing Sheets

(51) Int. Cl.

| | |
|---|---|
| ***C10N 20/00*** | (2006.01) |
| ***C10N 20/02*** | (2006.01) |
| ***C10N 20/04*** | (2006.01) |
| ***C10N 30/00*** | (2006.01) |
| ***C10N 30/02*** | (2006.01) |
| ***C10N 40/30*** | (2006.01) |

(52) U.S. Cl.
CPC ..... *C10M 2203/1025* (2013.01); *C10M 2205/026* (2013.01); *C10M 2205/0285* (2013.01); *C10M 2205/223* (2013.01); *C10M 2215/04* (2013.01); *C10N 2020/02* (2013.01); *C10N 2020/04* (2013.01); *C10N 2020/105* (2020.05); *C10N 2030/02* (2013.01); *C10N 2030/58* (2020.05); *C10N 2040/30* (2013.01)

(58) Field of Classification Search
CPC .... C10M 2205/026; C10M 2205/0285; C10M 2205/223; C10M 2215/04; C10N 2020/02; C10N 2020/04; C10N 2020/105; C10N 2030/02; C10N 2030/58; C10N 2040/30
See application file for complete search history.

(56) References Cited

U.S. PATENT DOCUMENTS

| | | | | |
|---|---|---|---|---|
| 9,758,743 | B2 | 9/2017 | Knapton et al. | |
| 2005/0084390 | A1* | 4/2005 | Ueno | C10M 171/008 417/313 |
| 2010/0093571 | A1* | 4/2010 | Paquette | C10M 169/04 508/501 |
| 2011/0059880 | A1* | 3/2011 | Short | C10M 111/04 508/501 |
| 2018/0223214 | A1* | 8/2018 | Shamszad | C10M 135/08 |
| 2019/0241827 | A1* | 8/2019 | Kaneko | C09K 5/042 |

* cited by examiner

LUBRICANTS FOR USE IN VAPOR-COMPRESSION SYSTEMS

CROSS REFERENCE TO RELATED APPLICATION

This application claims priority from PCT Application Serial No. PCT/US2022/022429 filed on Mar. 30, 2022, which claims the benefit of U.S. Provisional Application No. 63/169,488 filed on Apr. 1, 2021, both of which are incorporated in their entirety by reference herein.

FIELD OF THE INVENTION

The disclosed technology relates to lubricants for use in vapor-compression systems, wherein the refrigerant comprises a nitrogen-containing refrigerant, such as ammonia.

Anhydrous ammonia ($NH_3$) has long been used as a refrigerant in vapor-compression systems. It remains important because of its low cost and high thermodynamic efficiency. Although toxic at high concentrations, ammonia is readily biodegradable. In recent years, ammonia has received increased attention as a refrigerant because it has a global warming potential (GWP) potential of less than 1 and an ozone depletion rating of 0. The use of ammonia refrigerant, however, is not without its technical challenges. One such challenge is ammonia can be soluble in lubricants used for oil-flooded compressors at high temperatures and pressures. This combination of soluble ammonia and lubricant reduces the lubricant's working viscosity, thereby reducing the lubricant's ability to decrease friction and reduce wear of compressor machine elements, such as compressor screws, ball bearings, and races. Thus, there is a need for compressor lubricants that maintain good lubrication performance, in the presence of solubilized ammonia.

SUMMARY OF THE INVENTION

The disclosed technology pertains to lubricants that maintain good fluid film lubrication performance, even with ammonia or other amine-based refrigerant, such as methyl amine, solubilized therein. Accordingly, lubricant compositions are disclosed comprising an oil of lubricating viscosity and a viscosity modifier that is a hydrocarbon polymer having a number average molecular weight ($M_n$) of less than 10,000 Daltons (Da). The viscosity modifier is present at greater than 2 wt %, based on a total weight of the lubricant composition. Exemplary hydrocarbon polymers include, but are not limited to, olefin polymers, such as polyisobutylene polybutene, ethylene α-olefin copolymers, or combinations thereof.

The oil of lubricating viscosity may comprise at least one (i) polyalphaolefin ("PAO"), (ii) mineral oil, such as hydrotreated and severely hydrotreated mineral oils; (iii) gas-to-liquid ("GTL") hydrocarbon oils, such as saturated isoparaffinic oils (iv) alkylated naphthalene ("AN"), (v) alkylated benzenes, or (vi) combinations thereof.

These lubricants may have from 1 to 6 wt % of solubilized ammonia, based on a total weight of the lubricant composition. In some embodiments, the lubricant compositions may have an electrohydrodynamic film thickness greater than lubricant compositions without the viscosity modifier.

In some embodiments, vapor-compression systems charged with a lubricant composition comprising an oil of lubricating viscosity and a viscosity modifier that is a hydrocarbon polymer having a number average molecular weight ($M_n$) of less than 10,000 Daltons (Da) is disclosed.

The system may also be charged with a refrigerant comprising ammonia, methyl amine, or a combination thereof. The system may have a compressor that is an oil-flooded compressor, such as a reciprocating, scroll, rotary vane, rotary screw, twin-screw compressor, or any compressor that uses roller bearing or journal bearing machine elements. The system may be operated at discharge pressures of 30 to 100, or 30 to 80, or 30 to 50, or even 46 bar absolute ("bara") and discharge temperatures of 100 to 150° C. or, or 100 to 130° C., or 120 to 125° C.

Methods of lubricating a compressor using a lubricant as described above are also disclosed. Methods of increasing the elastohydrodynamic ("EHD") film thickness of a lubricant composition by adding a viscosity modifier as described above to a lubricant composition are also disclosed. Such methods may result in decreased wear and/or premature component failures, such as roller bearing failures. Uses of a viscosity modifier as described above to increase the EHD film thickness of a lubricant composition and/or reduce wear and/or component failures of a vapor-compression system are disclosed.

DETAILED DESCRIPTION OF THE INVENTION

Figure 1:
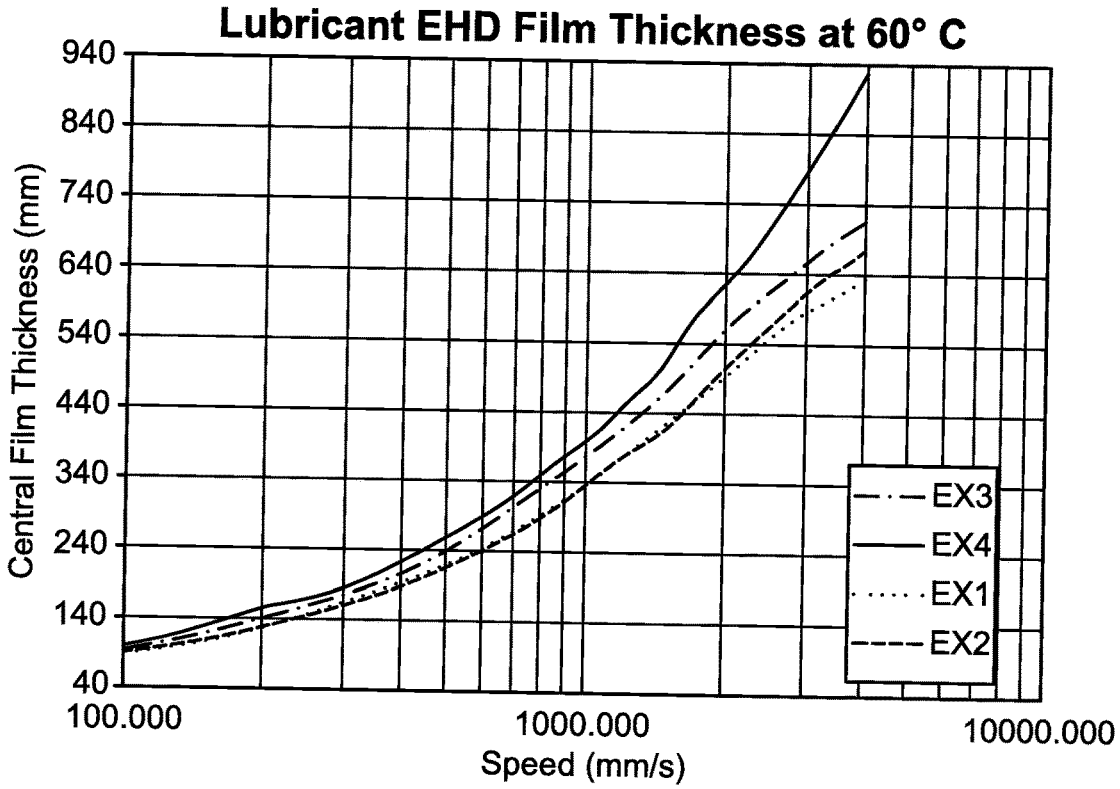
FIG. 1 shows the EHD film thickness of various lubricant compositions at 60° C.

Lubricant compositions are disclosed that maintain good lubricity performance, even with ammonia or other amine-based refrigerants, such as methyl amine, solubilized therein. Various features and embodiments of the disclosed technology will be described below by way of non-limiting illustration.

The lubricant composition may comprise an oil of lubricating viscosity and a viscosity modifier that is a hydrocarbon polymer having a number average molecular weight ($M_n$) of less than 10,000 Daltons (Da).

The number average molecular weight of the materials described herein is measured using gel permeation chromatography (GPC) using a Waters GPC 2000 equipped with a refractive index detector and Waters Empower™ data acquisition and analysis software. The columns are polystyrene (PLgel, 5 micron, available from Agilent/Polymer Laboratories, Inc.). For the mobile phase, individual samples are dissolved in tetrahydrofuran and filtered with PTFE filters before they are injected into the GPC port.

Waters GPC 2000 Operating Conditions

- Injector, Column, and Pump/Solvent compartment temperatures: 40° C.
- Autosampler Control: Run time: 40 minutes
- Injection volume: 300 microliter
- Pump: System pressure: ~90 bar (Max. pressure limit: 270 bar, Min. pressure limit: 0 psi)

The viscosity modifier may present at greater than 2 wt %, for example 2.5 wt %, based on a total weight of the lubricant composition. In some embodiments, the viscosity modifier may be present at 2.5 wt %, 3 wt %, 4 wt %, 5 wt %, 6 wt % to 10 wt % or to 20 wt %, based on a total weight of the lubricant composition. Additional ranges include greater than 2 wt % (such as 2.5 wt %), or 2 to 20 wt %, or 2 to 10 wt %, or 2 to 6 wt %, or greater than 2 to 5 wt %, or 2.5 to 5 wt %.

Suitable hydrocarbon polymers are not overly limited. The term "polymer" is used generically to encompass homopolymers, i.e., polymers of a single monomer, as well as copolymers, terpolymers and/or interpolymers. These materials may contain minor amounts of other olefinic monomers so long as their basic characteristics are not materially changed. Generally, the hydrocarbon polymers may have a number average molecular weight ($M_n$) of less than 10,000 Daltons (Da) or less than 8,000 Da. In some embodiments, the hydrocarbon polymer may have an $M_n$ of 250 to 2500 Da, or 500 to 2500 Da, or 1000 to 1,300 Da.

In some embodiments, the viscosity modifier may be a hydrocarbon polymer made from reactant materials containing an olefinic bond represented by the general formula:

$$(R^1)(R^2)C{=}C(R^6)(CH(R^7)(R^8)) \quad (I)$$

wherein each of $R^1$ and $R^2$ is, independently, hydrogen or a hydrocarbon-based group. Each of $R^6$, $R^7$ and $R^8$ is, independently, hydrogen or a hydrocarbon-based group; and preferably at least one is a hydrocarbon-based group containing at least 20 carbon atoms.

Olefin materials can include polymers comprising a major molar amount of $C_2$ to $C_{20}$ hydrocarbon groups, e.g. $C_2$ to $C_5$ monoolefins. Such olefins include ethylene, propylene, butylene, isobutylene, pentene, octene-1, or styrene. The polymers can be homopolymers such as polyisobutylene, as well as copolymers of two or more of such olefins such as copolymers of; ethylene and propylene; butylene and isobutylene; propylene and isobutylene. Other copolymers include those in which a minor molar amount of the copolymer monomers e.g., 1 to 10 mole % is a $C_4$ to $C_{18}$ diolefin, e.g., a copolymer of isobutylene and butadiene; or a copolymer of ethylene, propylene and 1,4-hexadiene.

In one embodiment, at least one R of formula (I) is derived from polybutene, that is, polymers of $C_4$ olefins, including 1-butene, 2-butene and isobutylene. $C_4$ polymers can include polyisobutylene. In another embodiment, at least one R of formula (I) is derived from ethylene-alpha olefin polymers, including ethylene-propylene-diene polymers. Ethylene-alpha olefin copolymers and ethylene-lower olefin-diene terpolymers are described in numerous patent documents, including European patent publication EP 0 279 863 and the following U.S. Pat. Nos. 3,598,738; 4,026,809; 4,032,700; 4,137,185; 4,156,061; 4,320,019; 4,357,250; 4,658,078; 4,668,834; 4,937,299; 5,324,800 each of which are incorporated herein by reference for relevant disclosures of these ethylene based polymers.

In some embodiments, the viscosity modifier may be an olefin polymer formed from ethylene and a higher olefin within the range of $C_3$-$C_{10}$ alpha-mono-olefins, for example, the olefin polymer may be prepared from ethylene and propylene. In one embodiment, the olefin polymer may be a polymer of 15 to 80 mole % of ethylene, for example, 30 mol % to 70 mol % ethylene and from and from 20 to 85 mole % of $C_3$ to $C_{10}$ mono-olefins, such as propylene, for example, 30 to 70 mol % propylene or higher mono-olefins. In some embodiments, the mole ratio is 30 to 80 mole % ethylene and 20 to 70 mole % of at least one $C_3$ to $C_{10}$ alpha monoolefin, for example, 50 to 80 mole % ethylene and 20 to 50 mole % propylene. Terpolymer variations of the olefin copolymer may also be used and may contain up to 15 mol % of a non-conjugated diene or triene. Non-conjugated dienes or trienes may have 5 to about 14 carbon atoms.

In one embodiment, the olefin polymer may be a polymer of ethylene, propylene, and butylene. The polymer may be prepared by polymerizing a mixture of monomers comprising ethylene, propylene and butylene. Such polymers may be referred to as terpolymers. In one embodiment of the invention, a useful terpolymer may comprise from about 5 mol % to about 20 mol %, or from about 5 mol % to about 10 mol % structural units derived from ethylene; from about 60 mol % to about 90 mol %, or from about 60 mol % to about 75 mol structural units derived from propylene; and from about 5 mol % to about 30 mol %, or from about 15 mol % to about 30 mol % structural units derived WO 2019/246192 PCT/US2019/037889-7—from butylene. The butylene may comprise any isomers or mixtures thereof, such as n-butylene, iso-butylene, or a mixture thereof. The butylene may comprise butene-1. Commercial sources of butylene may comprise butene-1 as well as butene-2 and butadiene. In one embodiment, the butylene may comprise a mixture of butene-1 and isobutylene wherein the weight ratio of butene-1 to isobutylene is about 1:0.1 or less. In another embodiment, the butylene may comprise butene-1 and be free of or essentially free of isobutylene.

In another embodiment, the olefin copolymer may be a polymer of ethylene and butylene, which may be prepared by polymerizing a mixture of monomers comprising ethylene and butylene wherein, the monomer composition is free of or substantially free of propylene monomers (i.e. contains less than 1 weight % of intentionally added monomer). In this embodiment, the copolymer may comprise 30 to 50 mol % structural units derived from butylene; and from about 50 mol % to 70 mol % structural units derived from ethylene. The butylene may comprise a mixture of butene-1 and isobutylene wherein the weight ratio of butene-1 to isobutylene is about 1:0.1 or less. The butylene may comprise butene-1 and be free of or essentially free of isobutylene.

In these embodiments, the polymer backbone (e.g., the ethylene copolymer or terpolymer), can be an oil-soluble, substantially linear material. Also, in certain embodiments, the polymer can be in forms other than substantially linear, that is, it can be a branched polymer or a star polymer. The polymer can also be a random copolymer or a block copolymer, including di-blocks and higher blocks, including tapered blocks and a variety of other structures.

Suitable olefin polymers include ethylene-a-olefin copolymers have a number average molecular weight, determined by Gel Permeation Chromatography (GPC) using a polystyrene standard, ranging 1000 to about 10,000, or about 1250 to about 9500, or about 1500 to about 9000, or about 1750 to about 8500, or about 2000 to about 8000, or about 2500 to about 7000 or 7500, or even about 3000 to about 6500, or about 4000 to about 6000. In some cases, the number average molecular weight can be from about 1000 to 5000, or from about 1500 or 2000 to about 4000.

Accordingly, in some embodiments the viscosity modifier may be polyisobutylene, polybutene, ethylene α-olefin copolymers, or combinations thereof. In other embodiments, the viscosity modifier is polyisobutylene having a number average molecular weight ($M_n$) of less than 10,000 Daltons (Da) or less than 8,000 Da. In some embodiments polyisobutylene may have an $M_n$ of 250 to 2500 Da or 500 to 2500 Da or 1000 to 1,300 Da. In yet another embodiment, the viscosity modifier is polyisobutylene having a number average molecular weight ($M_n$) of 1,300 Da.

In another embodiment, the olefinic bonds of formula (I) are predominantly vinylidene groups, represented by the following formulas:

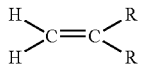

(II)

wherein R is a hydrocarbyl group

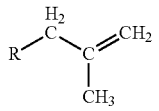

(III)

wherein R is a hydrocarbyl group.

In one embodiment, the vinylidene content of formula (I) can comprise at least 30 mole % vinylidene groups, at least 50 mole % vinylidene groups, or at least 70 mole % vinylidene groups. Such material and methods for preparing them are described in U.S. Pat. Nos. 5,071,919; 5,137,978; 5,137,980; 5,286,823, 5,408,018, 6,562,913, 6,683,138, 7,037,999 and U.S. Publication Nos. 20040176552A1, 20050137363 and 20060079652A1, which are expressly incorporated herein by reference, such products are commercially available by BASF, under the trade name GLISSOPAL® and by Texas PetroChemical LP, under the trade name TPC 1105™ and TPC 595™.

In other embodiments, the viscosity modifier may be a "conventional" vinylidene polyisobutylene (PIB) wherein less than 20% of the head groups are vinylidene head groups as measured by nuclear magnetic resonance (NMR). Alternatively, the viscosity modifier may be a mid-vinylidene PIB or a high-vinylidene PIB. In mid-vinylidene PIBs, the percentage of head groups that are vinylidene groups can range from greater than 20% to 70%. In high-vinylidene PIBs, the percentage of head groups that are vinylidene head groups is greater than 70%.

Oil of Lubricating Viscosity

The lubricant compositions as disclosed herein include, as one component, one or more oils of lubricating viscosity, which can be present in a major amount, for a lubricant composition, or in a concentrate forming amount, for a concentrate. Suitable oils include natural and synthetic lubricating oils and mixtures thereof. In a fully formulated lubricant, the oil of lubricating viscosity is generally present in a major amount (i.e. an amount greater than 50 percent by weight). Typically, the oil of lubricating viscosity is present in an amount of 75 to 95 percent by weight, and often greater than 80 percent by weight of the composition.

The oil of lubricating viscosity may comprise at least one (i) polyalphaolefin ("PAO"), (ii) mineral oil, such as hydrotreated and severely hydrotreated mineral oils; (iii) gas-to-liquid ("GTL") hydrocarbon oils, such as saturated isoparaffinic oils (iv) alkylated naphthalene ("AN"), (v) alkylated benzenes, or (vi) combinations thereof. The oil of lubricating viscosity may be selected based on its solubility properties with ammonia or amine-based refrigerants. Similarly, blends of different oils of lubricating viscosity may be so selected. For example, one or more of the oils (i) through (v) above may be selected and blended to have the desired viscosity and/or solubility properties. Accordingly, in one embodiment, the oil of lubricating viscosity may comprise at least one polyalphaolefin and at least one alkylated naphthalene. The oils of lubricating viscosity may also be selected and/or blended to achieve the desired International Standards Organization ("ISO") viscosity grade, which is the kinematic viscosity in centistokes ("cSt") at 40° C. In some embodiments the oil of lubricating viscosity may have an ISO viscosity grade ranging from 32 to 220 cSt at 40° C. In other embodiments, the oil of lubricating viscosity may have an ISO viscosity grade of 220 cSt at 40° C. In one or more embodiments, the oil of lubricating viscosity may be a blend of one or more oils of lubricating viscosity to achieve a desired ISO viscosity grade. In yet other embodiments, the oil of lubricating viscosity may comprise at least two polyalphaolefins having different kinematic viscosities.

Exemplary blends include blends of PAO oils having a neat viscosity of 134 cSt at 100° C. with PAO oils having a neat viscosity of 44 cSt or 65 cSt at 40° C. or with an alkylated naphthalene having a neat viscosity of 100 cSt at 40° C. As used herein, the neat viscosities may be measured according to ASTM D445.

INDUSTRIAL APPLICATION

The present methods, systems and compositions are thus adaptable for use in connection with a wide variety of heat transfer systems and refrigeration systems, such as air-conditioning (including both stationary and mobile air conditioning systems), refrigeration units, chillers, heat-pump systems, and the like. Suitable systems include vapor-compression systems. As used herein, vapor-compression systems include any system using the vapor-compression cycle in which the refrigerant undergoes phase changes as it transfers heat, for example vapor-compression refrigeration systems and vapor-compression heat (pump) transfer systems. In certain embodiments, the compositions of the present invention are used in refrigeration and/or heat transfer applications where ammonia or an amine-based refrigerant is used.

Accordingly, in some embodiments, the lubricant compositions disclosed herein may have from 1 to 6 wt % of solubilized ammonia and/or or an amine-based refrigerant such as methyl amine, therein, based on a total weight of the lubricant composition. In some embodiments, the lubricant compositions disclosed herein may have from 1 to 6 wt % of solubilized ammonia. In some embodiments, the lubricant compositions may have a larger electrohydrodynamic film thickness than lubricant compositions without the viscosity modifier. The EHD film thickness may be measured using an optical interferometer that measures the film thickness of a fluid between a rolling element (ball) and a flat optical plate (either glass or sapphire) during rolling operations.

In some embodiments, vapor-compression systems are charged with the lubricant compositions as described above. The system may also be charged with a refrigerant comprising ammonia, methyl amine, or a combination thereof. The system may have a compressor that is an oil-flooded compressor, such as a reciprocating, scroll, rotary vane, rotary screw, twin-screw compressor, or any compressor that uses roller bearing or journal bearing machine elements. The system may be operated at discharge pressures of 30 to 100, or 30 to 80, or 30 to 50. or even 46 bar absolute ("bara") and discharge temperatures of 100 to 150° C. or, or 100 to 130° C., or 120 to 125° C. In one embodiment, the system is operated at discharge pressures of 46 bar absolute and discharge temperatures of 120 to 125° C.

Methods of lubricating a compressor using a lubricant as described above is also disclosed. Methods of increasing the elastohydrodynamic ("EHD") film thickness of a lubricant composition by adding a viscosity modifier as described above to a lubricant composition are also disclosed. Such methods may result in decreased wear and/or decreased premature machine element failures, such as screw or roller bearing failures. Uses of a viscosity modifier as described above to increase the EHD film thickness of a lubricant composition and/or reduce wear and/or component failures of a vapor-compression system are disclosed.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The technology described herein may, in some instances, be better understood with reference to the following examples.

EXAMPLES

Various lubricant compositions were prepared using one or more polyolefin ("PAO") oils of lubricating viscosity having kinematic viscosities ranging from 44 cSt at 40° C. to 134 cSt 100° C. One lubricant composition, EX4, was prepared using a blend of alkylated naphthalene ("AN") having a kinematic viscosity of 100 cSt at 40° C. and PAO having a kinematic viscosity of 134 cSt 100° ° C. as the oil of lubricating viscosity. The formulations of the lubricant compositions are provided in Tables 1 through 4 below.

TABLE 1

EX1 formulation (ISO 220 PAO with no polymer).

| Component | Mass percent |
|---|---|
| PAO 44 cSt @ 40° C. | 54.9% |
| PAO 134 cSt @ 100° C. | 45.1% |

TABLE 1-continued

EX1 formulation (ISO 220 PAO with no polymer).

| Component | Mass percent |
|---|---|
| 1300 MW polyisobutylene | 0% |
| Total | 100% |

TABLE 2

EX2 formulation (ISO 220 PAO with 2 wt % polymer).

| Component | Mass percent |
|---|---|
| PAO 44 cSt @ 40° C. | 49.5% |
| PAO 134 cSt @ 100° C. | 48.5% |
| 1300 MW polyisobutylene | 2% |
| Total | 100% |

TABLE 3

EX3 formulation (ISO 220 PAO with 5 wt % polymer).

| Component | Mass percent |
|---|---|
| PAO 65 cSt @ 40° C. | 55% |
| PAO 134 cSt @ 100° C. | 45% |
| 1300 MW polyisobutylene | 5% |
| Total | 100% |

TABLE 4

EX4 formulation (ISO 220 AN with 5 wt % polymer).

| Component | Mass percent |
|---|---|
| AN 100 cSt @ 40° C. | 80% |
| PAO 134 cSt @ 100° C. | 15% |
| 1300 MW polyisobutylene | 5% |
| Total | 100% |

Figure 2:
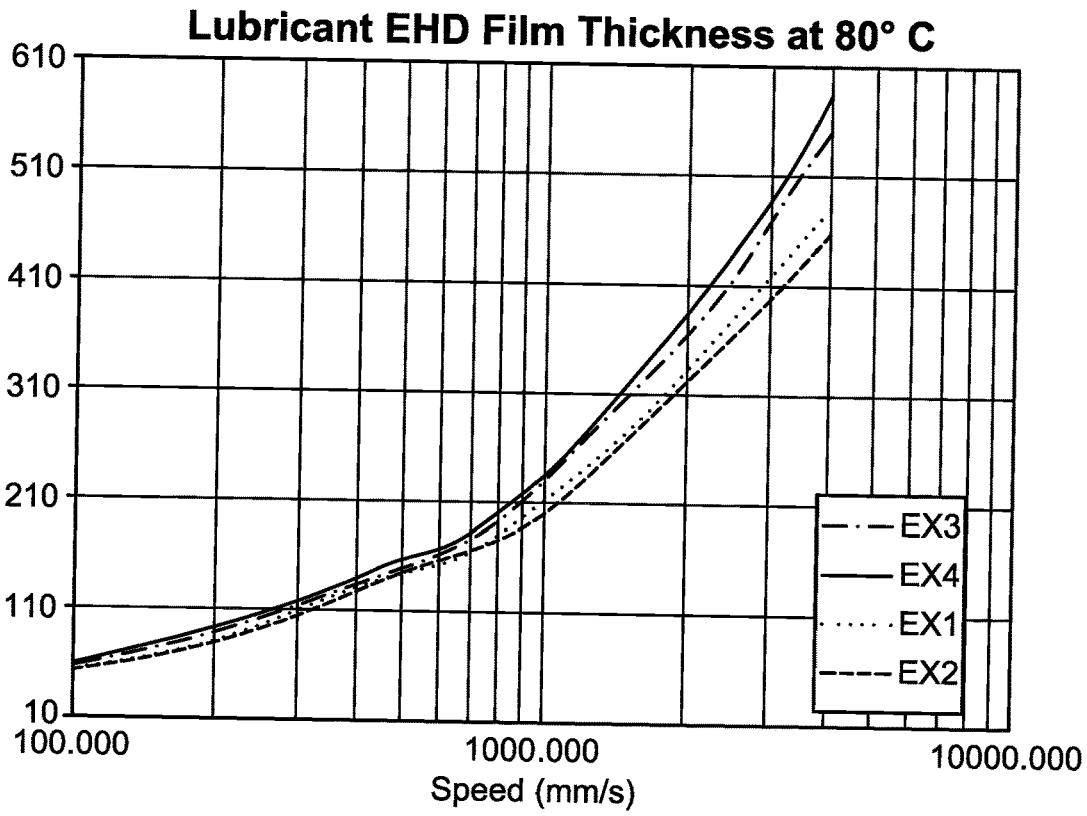
FIG. 2 shows the EHD film thickness of various lubricant compositions at 80° C.
Figure 3:
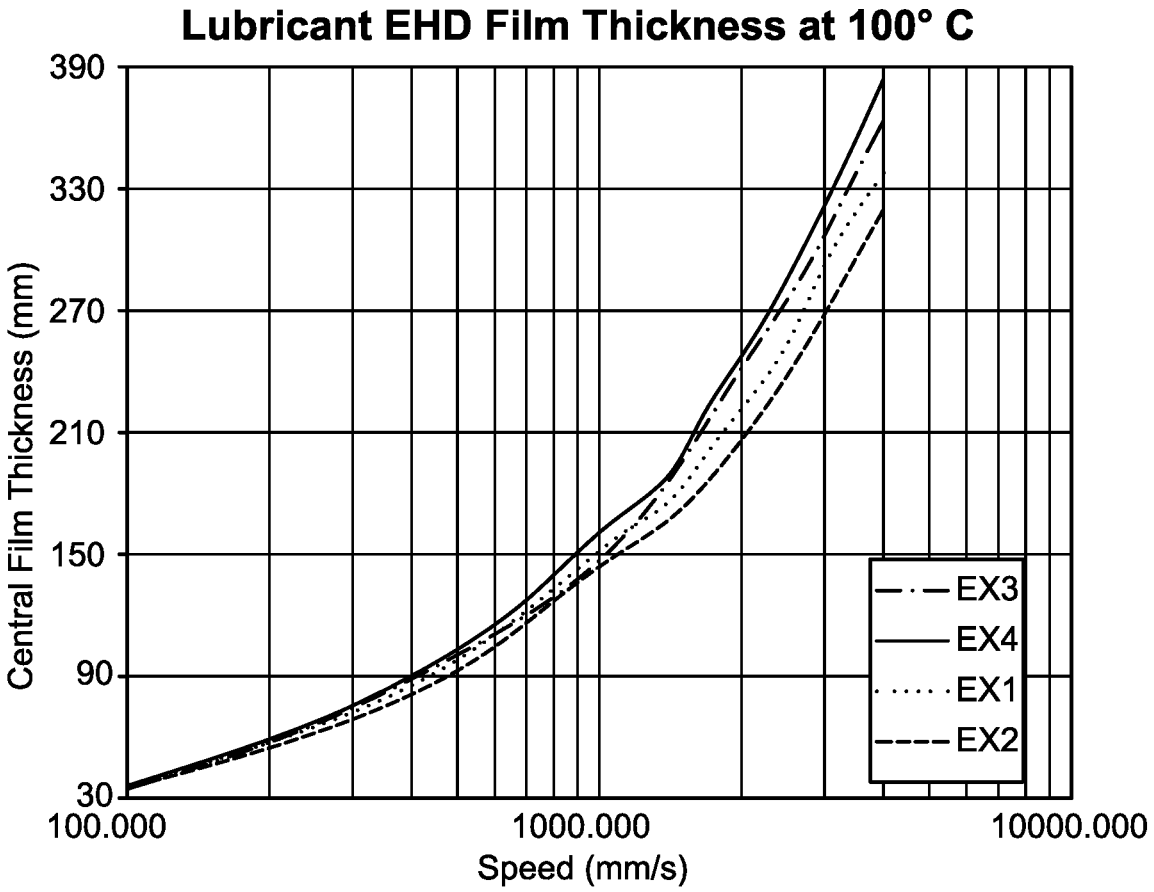
FIG. 3 shows the EHD film thickness of various lubricant compositions at 100° C.

The elastohydrodynamic ("EHD") film thickness is measured a using a PCS EHD2 test instrument (www.pcs-instruments.com) at temperatures of 60° C., 80° C., and 100° C. The method used is ARP6157A: Pressure-Viscosity Coefficient Measurement. Copies of the test method are available from SAE International. The EHD film thickness of the examples at 60° C. is shown in FIG. 1. The EHD film thickness of the examples at 80° C. is shown in FIG. 2. The EHD film thickness of the examples at 100° C. is shown in FIG. 3. As shown in the figures, EX3 and EX4 have a greater film thickness at all three temperatures as compared to the lubricant without the viscosity modifier, EX1. It is believed that this greater film thickness results in less wear and reduced failures in the compressors.

EX2, EX3 and EX4 are then subjected to an end of line (EOL) test. The EOL test serves to test the compressor operation after the compressor is assembled. The compressor tested is a vapor compression system with ammonia as the refrigerant. The calculated operating conditions for the EOL test are provided in Table 4a below.

TABLE 4a

| | Pressure (Barg) | Temperature (° C.) | Viscosity (cSt.) | kappa |
|---|---|---|---|---|
| Evaporator | 6.74 | 37.7 | | |
| Condenser | 32.1 | 70 | | |
| Discharge | 32.1 | 112 | | |
| Bearings | 6.74 | 71 | 17 | n.a. |
| 2900 RPM | 6.74 | 70 | 60 | 9.4 |
| 1400 RPM | 6.74 | 70 | 60 | 6.8 |

After running for 24 hours in the EOL test, the compressor is disassembled and inspected for wear. The compressor inspection after the EOL test for EX2 showed some wear, dents and scratches on several compressor components, including the screw, damper, inner race, and cylinder bore. No scratches or other signs of wear were visible for EX3 and EX4.

EX4 is then tested in an ammonia compressor for comparison to a commercially available ISO 220 polyalphaolefin lubricant, EX5 and EX6. A sample of the commercial lubricant is retained before the lubricant is charged into the compressor ("Commercial Control"). The compressors that are operated using the commercially available lubricant, EX5 and EX6, have visible damage to their components in as little as 10 hours of operation in an EOL test. Significant damage can be observed on the inner races of angular contact thrust bearings after 200 hours of operation.

After approximately 6000 hours, the commercially available lubricants, EX5 and EX6, are drained from the compressors and samples of each are retained. The compressors are then charged with the EX4 lubricant. A sample of the EX4 is retained before the lubricant is charged into the compressor ("EX4 Control"). After 2000 hours of operation, a second sample of EX4 is obtained from one of the compressors. This sample of EX4 is compared to the retained samples EX5 and EX6, the Commercial Control and the EX4 Control. A summary of the sample analysis is provided in Table 5 below.

The viscosity data and color properties of the lubricant samples EX4, EX5, and EX6 appear to be normal and the total acid numbers (TAN) and water content levels are low, as expected. As such it appears the compressor wear observed when operated with the EX5 and EX6 lubricant is not the result of a degradation in lubricating oil viscosity.

The induction-coupled plasma (ICP) elemental analysis provides information on the failure. Low levels of iron (Fe) in used compressor oils are common, but elevated iron (Fe) levels in used samples can indicate compressor/roller bearing failures. Elevated chrome (Cr) levels come from 52100 steel and indicates a roller bearing failure. Zinc (Zn) may be present from the rolling element bearing brass cage wear.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the term "comprising" is intended also to encompass as alternative embodiments "consisting essentially of" and "consisting of." "Consisting essentially of" permits the inclusion of substances that do not materially affect the basic and novel characteristics of the composition under consideration.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

TABLE 5

| Sample ID | | EX5 Commercial failure | EX6 Commercial failure | Commercial control | EX4 | EX4 Control |
|---|---|---|---|---|---|---|
| Test | Method | Result | Result | Result | Result | Result |
| Runtime, hours | | 6000 | 6000 | 0 | 2000 | 0 |
| Viscosity 40° C., cSt | ASTM D445 | 204.1 | 190.8 | 219.1 | 223.1 | 225.59 |
| Percent change | — | 6.8% decrease | 12.9% decrease | — | 1.1% increase | — |
| Viscosity 100° C., cSt | ASTM D445 | 24.81 | 23.57 | 25.9 | 24.49 | 24.34 |
| Viscosity Index | ASTM D2270 | 152 | 152 | 151 | 138 | 135 |
| Density 20.0° C., g/mL | ASTM D4052 | 0.841 | 0.841 | — | 0.874 | 0.878 |
| TAN, mg KOH/g | ASTM D974 | 0.04 | 0.02 | — | 0.03 | 0.01 |
| Metals, ppm | ICP | — | — | — | All <1 | All <1 |
| | Fe | 14.8 | 5.8 | — | — | — |
| | Si | 2.5 | — | — | — | — |
| | Zn | 14.5 | 4.9 | — | — | — |
| | Cr | — | 1.5 | — | — | — |
| | P | — | 4.7 | — | — | — |
| Water, ppm | Karl Fischer | 26.4 | 1 | — | 15.7 | 12.7 |
| Color | ASTM D1500 | 3.9 | 2.5 | — | 1.6 | 1.4 |

What is claimed is:

1. A lubricant composition comprising:

a. an oil of lubricating viscosity having an ISO viscosity grade of 220 at 40° C. and comprising: (i) at least two polyalphaolefins ("PAO"), or (ii) at least one polyalphaolefin ("PAO") and an alkylated naphthalene ("AN"), wherein at least one PAO of (i) or (ii) is a PAO oil having a neat viscosity of 134 cSt at 100° C., and b. 2.5 to 10 wt % of a viscosity modifier that is a hydrocarbon polymer that is polyisobutylene and having a number average molecular weight ($M_n$) of 1000 to 2500 Daltons (Da), based on a total weight of the lubricant composition;

wherein the lubricant composition further comprises 1 to 6 wt % solubilized ammonia and/or an amine-based refrigerant therein.

2. The lubricant composition of claim 1, wherein the lubricant composition has a greater elastohydrodynamic ("EHD") film thickness than a lubricant composition without the viscosity modifier.

3. The lubricant composition of claim 2, wherein the EHD film thickness is measured using an optical interferometer.

4. A vapor-compression system charged with the lubricant composition of claim 1, wherein the system compressor is an oil-flooded compressor that uses roller bearing or journal bearing machine elements.

5. The system of claim 4, wherein the system is charged with a refrigerant comprising ammonia, methyl amine, or a combination thereof.

6. The system of claim 5, wherein the refrigerant is ammonia.

7. The system of claim 4, wherein the system compressor is a reciprocating, scroll, rotary vane, rotary screw, or twin-screw compressor.

8. The system of claim 4, wherein the lubricant composition comprises solubilized ammonia and/or an amine-based refrigerant present at 1 to 6 wt % based on a total weight of the lubricant composition, when the system is operating at discharge pressures of 30 to 100 bar absolute ("bara") and discharge temperatures of 100 to 150° C.

9. A method of lubricating a compressor of a vapor-compression system, the method comprising:

a. supplying the lubricant composition of claim 1 to the compressor; and b. operating the compressor, wherein compressor is an oil-flooded compressor that uses roller bearing or journal bearing machine elements.

10. The method of claim 9, wherein the system is charged with a refrigerant comprising ammonia, methyl amine, or a combination thereof.

11. The method of claim 10, wherein the refrigerant is ammonia.

12. The method of claim 9, wherein the compressor is a reciprocating, scroll, rotary vane, rotary screw, or twin-screw compressor.

13. A method of reducing wear and/or premature component failures in of a vapor-compression system, the method comprising:

a. supplying the lubricant composition of claim 1 to the compressor;
and b. operating the compressor, wherein compressor is an oil-flooded compressor that uses roller bearing or journal bearing machine elements.

14. The lubricant composition of claim 1, wherein the oil of lubricating viscosity comprises at least one PAO oil having a neat viscosity of 134 cSt at 100° C. and an alkylated naphthalene having a neat viscosity of 100 cSt at 40° C.

15. The lubricant composition of claim 1, wherein the oil of lubricating viscosity comprises at least 80 wt % alkylated naphthalene.

16. The lubricant composition of claim 1, wherein the oil of lubricating viscosity comprises at least 80 wt % alkylated naphthalene having a neat viscosity of 100 cSt at 40° C.

17. The lubricant composition of claim 1, wherein the viscosity modifier is present at 4 to 10 wt %, based on a total weight of the lubricant composition, and is a hydrocarbon polymer that is polyisobutylene having a $M_n$ of 1,300 Da.

* * * * *